US006190201B1

(12) United States Patent
Shih et al.

(10) Patent No.: US 6,190,201 B1
(45) Date of Patent: Feb. 20, 2001

(54) ELECTRICAL CONNECTOR

(75) Inventors: Kelly Shih; Kuang-Kai Kuo, both of Tu-Chen (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/298,368

(22) Filed: Apr. 22, 1999

(30) Foreign Application Priority Data

Feb. 9, 1999 (TW) ..... 88202224

(51) Int. Cl.[7] ..... H01R 13/73
(52) U.S. Cl. ..... 439/567
(58) Field of Search ..... 439/567, 571–573

(56) References Cited

U.S. PATENT DOCUMENTS 5,074,807 * 12/1991 Parmer ..... 439/567
5,135,412 * 8/1992 Sitzler ..... 439/567
5,468,160 * 11/1995 Broschard, III ..... 439/567
5,664,965 * 9/1997 Clark et al. ..... 439/567

* cited by examiner

*Primary Examiner*—Gary F. Paumen
(74) *Attorney, Agent, or Firm*—Wei Te Chung

(57) ABSTRACT

An electrical connector includes an insulative housing, a number of contacts received in the housing and boardlocks. The housing defines a bottom mounting face and at least two apertures in the bottom mounting face for retaining the boardlocks therein. By choosing boardlocks of different overall height, the bottom mounting face of the housing can be spaced above a circuit board a desired height.

1 Claim, 4 Drawing Sheets

ELECTRICAL CONNECTOR

BACKGROUND OF THE INVENTION

The present invention relates to a connector, and especially to a connector that can be quickly adapted as to its height with respect to a circuit board on which the connector is mounted.

U.S. Pat. Nos. 5,074,807; 5,135,412; and 5,664,965 each disclose an electrical connector including a housing, a plurality of contacts received in the housing and a boardlock member for fixing the connector to a printed circuit board. The boardlock member comprises a mounting portion attached to the printed circuit board and an engaging portion received in the housing. When a change of height between the printed circuit board and a profile of the housing is desired, the prior art connectors must be provided with a new housing. However, the additional manufacture of another new housing wastes time and cost. Hence, an improved electrical connector is required to overcome the disadvantages of the prior art.

BRIEF SUMMARY OF THE INVENTION

An object of the present invention is to provide an electrical connector having elevating means for quickly adapting as to a height between the connector and a circuit board on which the connector is mounted whereby the elevating means can be manufactured easily and economically.

Accordingly, an electrical connector includes an insulative housing, a plurality of contacts received in the housing and a plurality of boardlocks. The insulative housing comprises a first section and a second section. The first section defines a plurality of contact receiving cavities. The second section forms a top face and a bottom mounting face. Each boardlock has an engaging portion for being secured in the second section of the insulative housing, a mounting portion adapted for being mounted to the circuit board, and an intermediate portion extending beyond the bottom mounting face of the insulative housing. The intermediate portion has a pair of stoppers laterally extending from opposite sides thereof. Each stopper has a bottom face for abutting against a top surface of the circuit board thereby defining an observed height of the insulative housing with respect to the circuit board which is substantially equal to the distance between the bottom face of the stopper and the bottom mounting face of the insulative housing.

Other objects, advantages and novel features of the invention will become more apparent from the following detailed description of the present embodiment when taken in conjunction with the accompanying drawings.

DETAILED DESCRIPTION OF THE INVENTION

Figure 1:
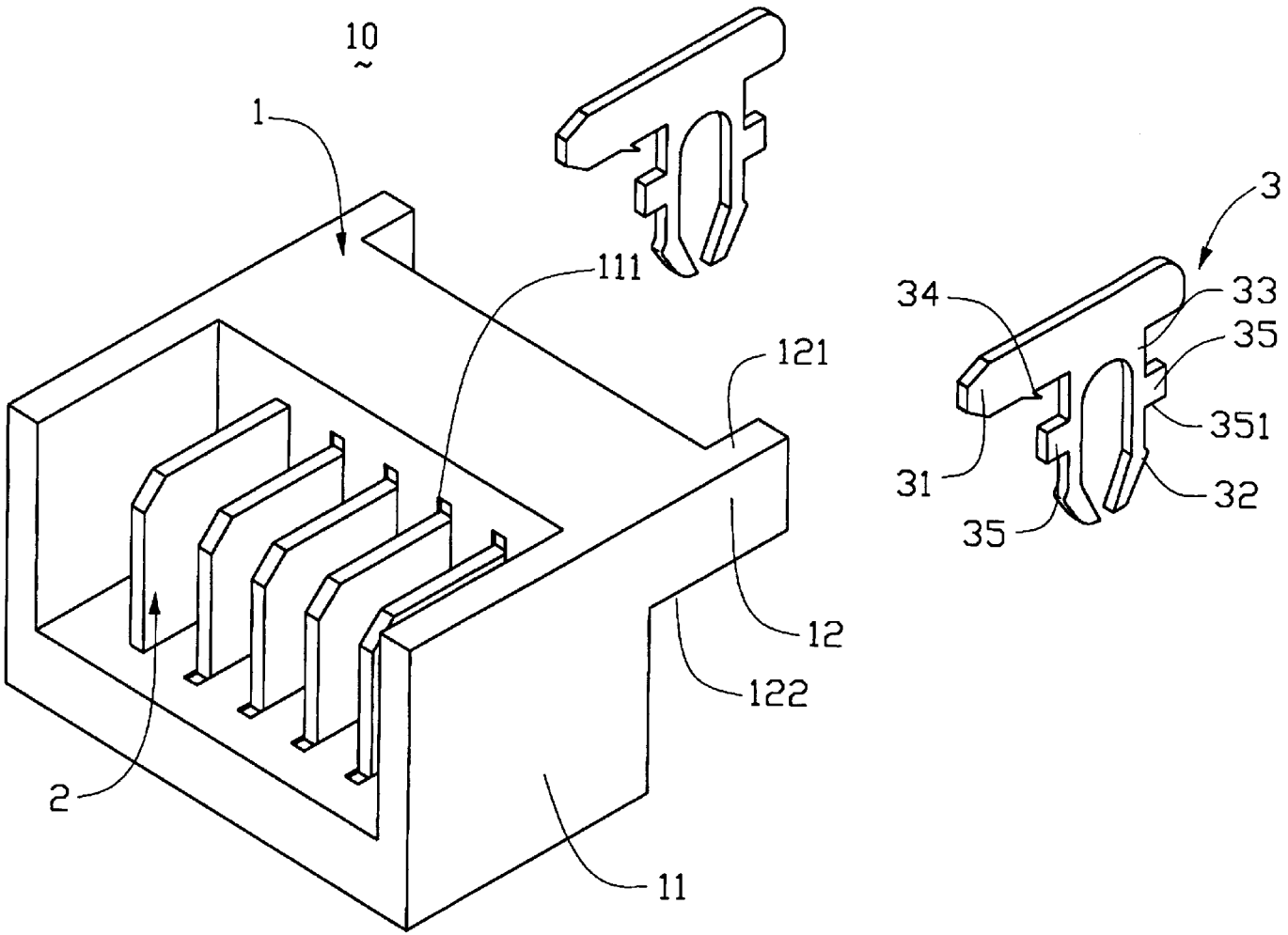
FIG. 1 is a perspective view of an electrical connector of the present invention and a pair of boardlocks to be assembled thereto.

Referring to FIG. 1, an electrical connector 10 includes a housing 1, a plurality of contacts 2 and several boardlocks 3. The housing 1 defines a first section 11 and a second section 12. The first section 11 defines a plurality of contact receiving cavities 111. The second section forms a top face 121, a bottom mounting face 122 and at least a pair of apertures 123 in the bottom mounting face 122 for retaining the boardlocks 3 therein.

Figure 2:
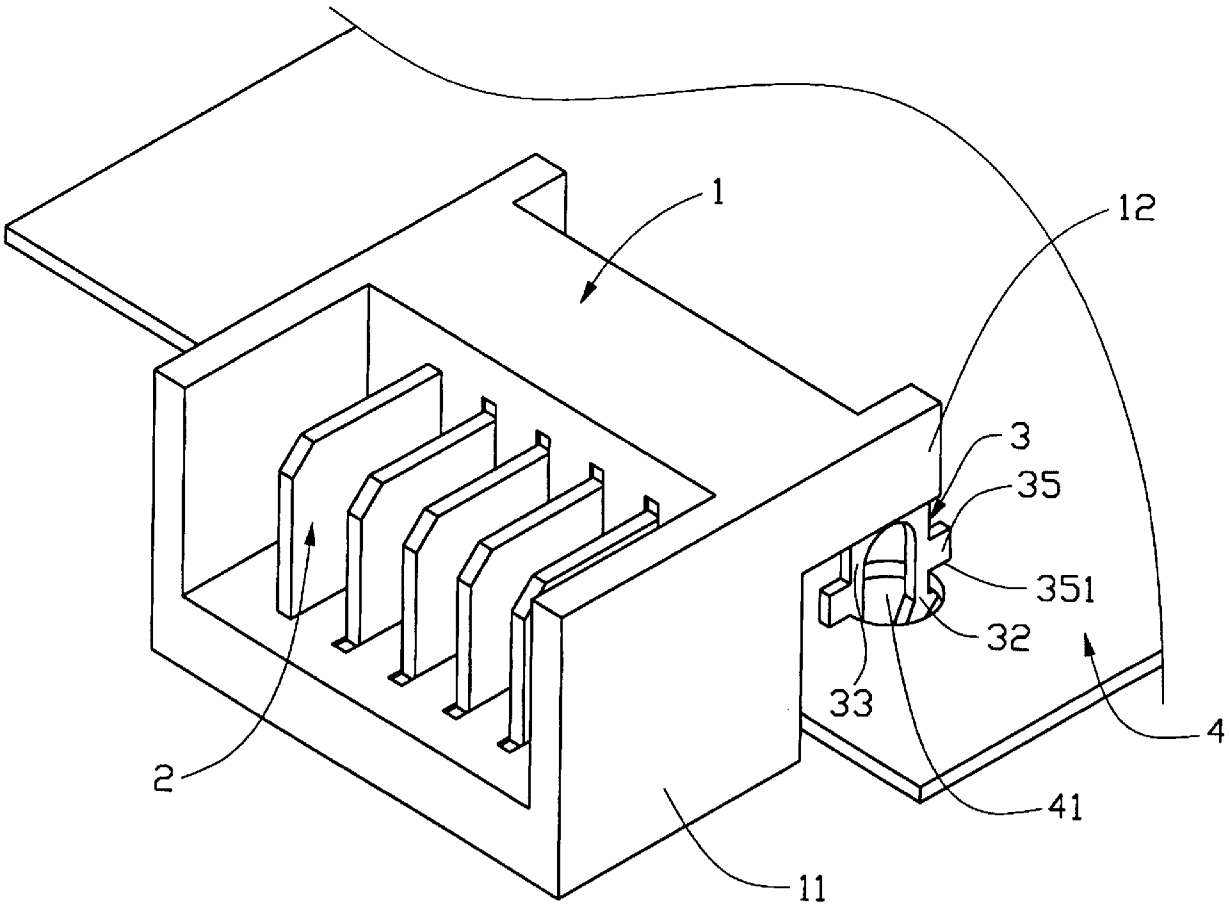
FIG. 2 is a perspective view of the electrical connector of the present invention mounted on a circuit board.
Figure 3:
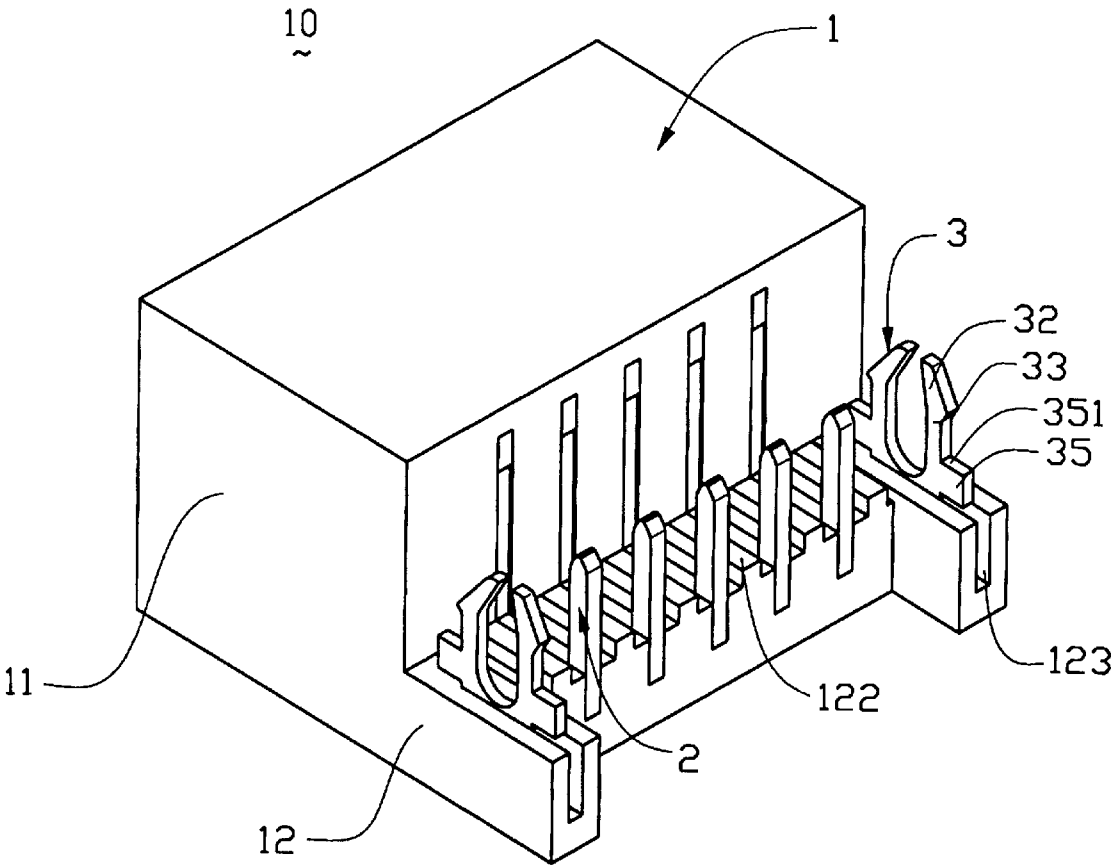
FIG. 3 is a bottom perspective view of the electrical connector of the present invention.
Figure 4:
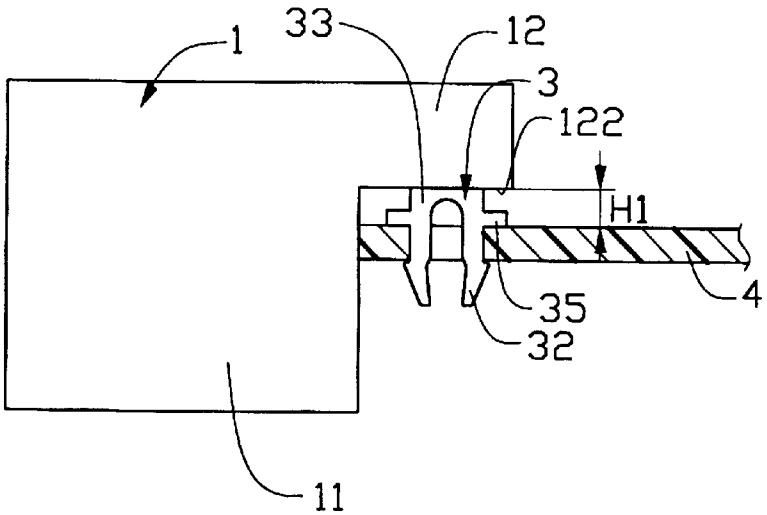
FIG. 4 is a plan view of the electrical connector of the present invention showing the boardlocks engaged with the circuit board.

Further referring to FIGS. 2 and 3, each boardlock 3 has an engaging portion 31 received in the aperture 123 of the second section 12 of the housing 1, a mounting portion 32 received in a hole 41 defined in a circuit board 4 and an intermediate portion 33 extending beyond the bottom mounting face 122 of the insulative housing 1. The engaging portion 31 forms a burr 34 thereon for securing the boardlock 3 within the aperture 123 of the housing 1. The intermediate portion 33 forms a pair of stoppers 35 laterally extending from opposite sides thereof. Each stopper 35 has a bottom face 351 for abutting against a top surface of the circuit board 4 thereby defining an observed height H1 (FIG. 4) of the insulative housing 1 above the circuit board 4 which is substantially equal to the distance between the bottom face 351 of the stopper 35 and the bottom mounting face 122 of the insulative housing 1. Referring to FIG. 1 again, the engaging portion 31 laterally extends a distance greater than the stopper 35. The engaging portion 31 is engageably received in the aperture 123 of the insulative housing 1 and extends in a direction generally parallel to the bottom mounting face 122 of the insulative housing 1.

Figure 5:
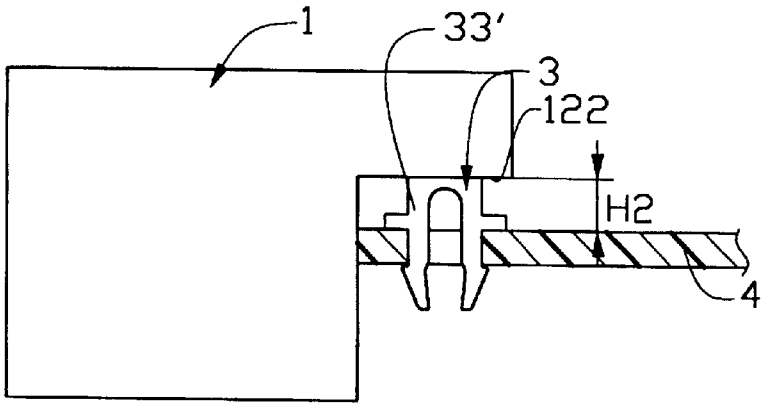
FIG. 5 is similar to FIG. 4 but having a different boardlock.

A similar boardlock 3' is supplied by the present invention except for the different length of an intermediate portion 33' of the boardlock 3'. The boardlocks 3' elevate the bottom mounting face 122 of the housing 1 a height H2 above the circuit board 4 (FIG. 5). Thus, the boardlocks of the different lengths, i.e., the different standoff distances between the engagement portion and the stopper, can be adapted to easily adjust the height between the bottom mounting face 122 of the housing 1 and the circuit board 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector mounted to a circuit board, comprising:

an insulative housing defining a bottom mounting face for mounting on a circuit board, and an aperture in the bottom mounting face and a plurality of contact receiving cavities;

a plurality of contacts received in the contact receiving cavities; and at least one boardlock having an engaging portion for being secured to the insulative housing, a mounting portion adapted for being mounted to the circuit board, and an intermediate portion extending beyond the bottom mounting face of the insulative housing, the intermediate portion having at least a stopper laterally extending therefrom, said stopper having a bottom face for abutting against a top surface of the circuit board, an observed height of the insulative housing with respect to the circuit board being defined which is substantially equal to a distance between the bottom face of the stopper and the bottom mounting face of the insulative housing, wherein the engaging portion of the at least one boardlock laterally extends a greater distance than the stopper and is engageably received in the aperture in the bottom mounting face of the insulative housing;

wherein the height of the insulative housing above the circuit board is governed by a length of the intermediate portion of the at least one boardlock;

wherein the engaging portion of the at least one boardlock extends in a direction parallel to the bottom mounting face of the insulative housing.

* * * * *